US011090940B2

(12) United States Patent
Kato

(10) Patent No.: US 11,090,940 B2
(45) Date of Patent: Aug. 17, 2021

(54) LIQUID EJECTION HEAD

(71) Applicant: CANON KABUSHIKI KAISHA, Tokyo (JP)

(72) Inventor: Masataka Kato, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/723,399

(22) Filed: Dec. 20, 2019

(65) Prior Publication Data

US 2020/0198352 A1 Jun. 25, 2020

(30) Foreign Application Priority Data

Dec. 25, 2018 (JP) ..... JP2018-240864

(51) Int. Cl.
*B41J 2/16* (2006.01)
*B41J 2/14* (2006.01)

(52) U.S. Cl.
CPC ..... *B41J 2/1631* (2013.01); *B41J 2/1404* (2013.01); *B41J 2/1626* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 7,802,878 | B2 | 9/2010 | Kyoso | |
| 8,518,725 | B2 | 8/2013 | Terasaki et al. | |
| 2006/0023032 | A1* | 2/2006 | Bibl | B41J 2/14233 347/68 |
| 2013/0083136 | A1* | 4/2013 | Govyadinov | B41J 2/1753 347/85 |

FOREIGN PATENT DOCUMENTS

| | | | |
|---|---|---|---|
| JP | 10-34928 | A | 2/1998 |
| JP | 10-95119 | A | 4/1998 |
| JP | 2008-142910 | A | 6/2008 |
| JP | 2011-161915 | A | 8/2011 |

OTHER PUBLICATIONS

U.S. Appl. No. 16/725,425, Masataka Kato, filed Dec. 23, 2019.

* cited by examiner

*Primary Examiner* — Erica S Lin
(74) *Attorney, Agent, or Firm* — Venable LLP

(57) ABSTRACT

A liquid ejection head includes an ejection orifice for ejecting a liquid; a substrate on which an energy-generating element and an insulating layer are formed on a first surface; a liquid inflow path which penetrates the substrate and makes a liquid flow in a flow path disposed between the ejection orifice and the element; and a liquid outflow path which penetrates the substrate and makes the liquid flow out of the flow path. The liquid inflow path and the liquid outflow path have a first opening and a second opening penetrating the insulating layer on the first surface of the substrate, the ejection orifice is disposed between the liquid inflow path and the liquid outflow path, and an ejection orifice side end of the second opening is formed closer to the ejection orifice than an ejection orifice side end of the first opening.

12 Claims, 10 Drawing Sheets

LIQUID EJECTION HEAD

BACKGROUND OF THE INVENTION

Field of the Invention

The present invention relates to a liquid ejection head.

DESCRIPTION OF THE RELATED ART

As a liquid ejection head used in a recording device such as an ink jet printer, there is a liquid ejection head, in which a flow path is provided on a substrate on which a supply path is formed, energy from an energy-generating element is applied to a liquid in a flow path, and a liquid is ejected from an ejection orifice. Japanese Patent Application Laid-Open No. 2011-161915 discloses a liquid ejection head having a substrate on which two through-holes serving as supply paths are formed. The two through-holes are composed of independent supply paths which are independent of each other and a common supply path which is common to the independent supply paths. By supplying the liquid from the independent supply paths which are independent of the flow path on the substrate, liquid supply performance is improved and a liquid ejection direction is also stabilized. For this reason, it is possible to perform recording by high-speed liquid ejection with high precision.

In the liquid ejection head, if the energy-generating element is not driven for a long time, a liquid in a pressure chamber in which the energy-generating element is disposed is in contact with the outside air for a long time in the vicinity of the ejection orifice, and volatile components in the liquid may evaporate. When the volatile components in the liquid evaporate, a concentration of a coloring material in the liquid changes, resulting in color unevenness in a recorded image, or a landing position is shifted due to an increase in the viscosity of the liquid, to make it difficult to form an image to be desired accurately. As one of the countermeasures against such problems, a circulation type liquid ejection apparatus that circulates a liquid supplied to a pressure chamber of a liquid ejection head through a circulation path is known.

Japanese Patent Application Laid-Open No. 2008-142910 discloses a liquid ejection apparatus which includes a circulation path from a liquid tank, via a common inflow path, an individual inflow path, a pressure chamber, an individual outflow path, and a common outflow path, back to the liquid tank, and suppresses thickening of a liquid in the vicinity of the ejection orifice in a state of being not ejected.

On the other hand, in order to perform further high-speed recording in the liquid ejection head, it is required to refill the liquid in the flow path on the energy-generating element more quickly after ejection of the liquid. For this purpose, it is effective to reduce the flow resistance by shortening a flow path distance from the supply path to the energy-generating element. Japanese Patent Application Laid-Open No. H10-095119 and Japanese Patent Application Laid-Open No. H10-034928 disclose a liquid ejection head of a non-circulating system in which the height of the flow path is increased near the supply path by removing the substrate near the supply path. With such a liquid ejection head, flow resistance from the supply path to the energy-generating element can be lowered, and the refill efficiency can be improved.

However, there are various cases in which the liquid ejection apparatus including a circulation path disclosed in Japanese Patent Application Laid-Open No. 2008-142910 is used. For example, when a special liquid is used, when it is used in a high temperature environment, when a circulating flow rate is small, when a flow path height of the pressure chamber is low and an ejection orifice area is large, or in other cases, the liquid ejection apparatus including a circulation path is used. In such a case, the liquid is more likely to volatilize from the ejection orifice, and a portion having a high liquid concentration may remain in the vicinity of the ejection orifice. Therefore, even in the case that the liquid circulates, the liquid in the vicinity of the ejection orifice is not sufficiently replaced, and as a result, quality of an image to be recorded may be deteriorated.

SUMMARY OF THE INVENTION

The liquid ejection head according to the present invention includes:

an ejection orifice for ejecting a liquid;

a substrate in which an energy-generating element which generates energy for ejecting the liquid from the ejection orifice and an insulating layer which protects the energy-generating element from the liquid are formed on a first surface;

a liquid inflow path which penetrates from the first surface of the substrate to a second surface opposing the first surface and makes a liquid flow in a flow path disposed between the ejection orifice and the energy-generating element; and a liquid outflow path which penetrates from the first surface of the substrate to the second surface and makes the liquid flow out of the flow path, in which the liquid inflow path and the liquid outflow path have a first opening penetrating the substrate and a second opening penetrating the insulating layer on the first surface of the substrate, the ejection orifice is disposed between the liquid inflow path and the liquid outflow path, and an end of the second opening on an ejection orifice side is formed closer to the ejection orifice side than an end of the first opening, when a distance from a center position of the ejection orifice to the end of the first opening on a liquid inflow path side is L1, a distance from the center position of the ejection orifice to the end of the first opening on a liquid outflow path side is L2, a distance from the center position of the ejection orifice to the end of the second opening on the liquid inflow path side is L3, and a distance from the center position of the ejection orifice to the end of the second opening on the liquid outflow path side is L4, $L1 \leq L2$ and $L3 \leq L4$ are satisfied, when $L1=L2$ is satisfied, $L3<L4$ is satisfied, and when $L3=L4$ is satisfied, $L1<L2$ is satisfied.

Further features of the present invention will become apparent from the following description of exemplary embodiments with reference to the attached drawings.

DESCRIPTION OF THE EMBODIMENTS

An object of the present invention is to provide a liquid ejection head having a structure capable of relieving a portion having a high liquid concentration in the vicinity of an ejection orifice, regardless of conditions, in the liquid ejection head having a liquid circulation path.

Hereinafter, a liquid ejection head according to an embodiment of the present invention will be described with reference to the drawings. In the embodiments described below, specific descriptions may be given in order to fully describe the present invention, but these are merely technically preferred examples, and particularly, are not intended to limit the scope of the present invention.

A liquid ejection head is a member included in a recording device such as an ink jet printer. The recording device includes a liquid storage unit which stores a liquid to be supplied to other liquid ejection heads, a conveyance mechanism of a recording medium which performs recording, and the like. The liquid ejection head to which the present invention is applied, is applied to a recording device including a circulation mechanism for circulating the liquid in the vicinity of an ejection orifice, and includes a circulation path therefor. This allows the liquid in a flow path of the liquid ejection head to be circulated between the flow path and the outside of the liquid ejection head.

Incidentally, in the case of the liquid ejection head including the circulation path, a portion having a high liquid concentration which is likely to be formed in the vicinity of the ejection orifice is relieved by the circulation of the liquid. However, depending on conditions, even in the case that the liquid circulates, a portion having a high liquid concentration in the vicinity of the ejection orifice is not sufficiently relieved, and the quality of an image to be recorded may be deteriorated. Examples of such condition include conditions where a special liquid is used, where a recording device is used in a high temperature environment, and where the circulation flow rate is low. Further, there are conditions such as conditions where a flow path height of the flow path (also referred to as a pressure chamber) in the vicinity of an energy-generating element is low and an ejection orifice area is large, and where the liquid is more likely to volatilize than in the ejection orifice.

Therefore, the present invention provides a structure which can sufficiently relieve the portion having a high liquid concentration by circulation of the liquid, regardless of the conditions.

Hereinafter, each embodiment of the present invention will be described in detail.

Embodiment 1

Figure 1A:
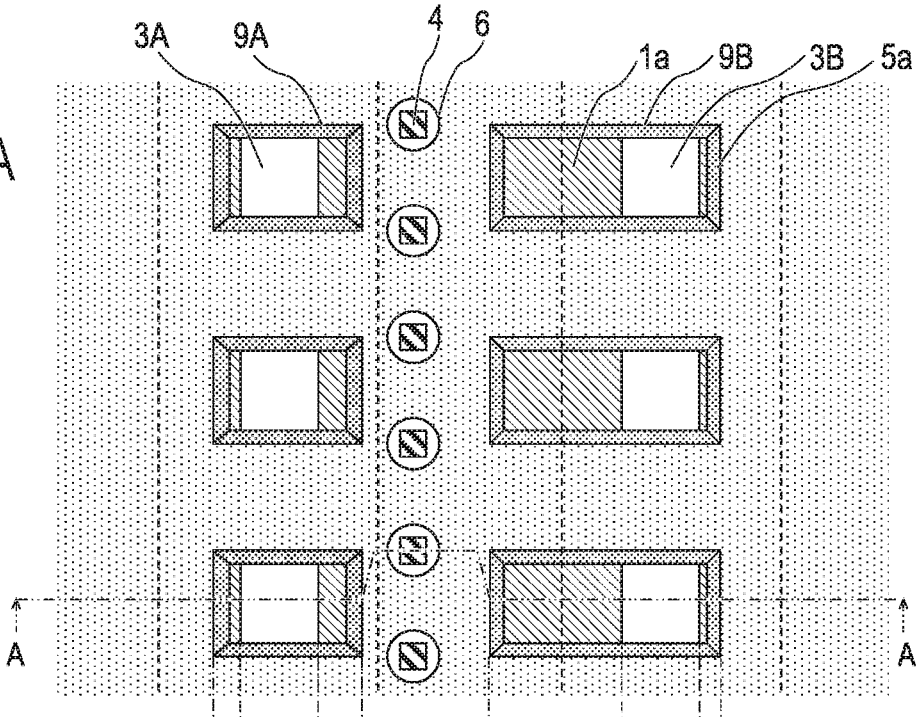
FIG. 1A is a top view of a liquid ejection head of Embodiment 1.
Figure 1B:
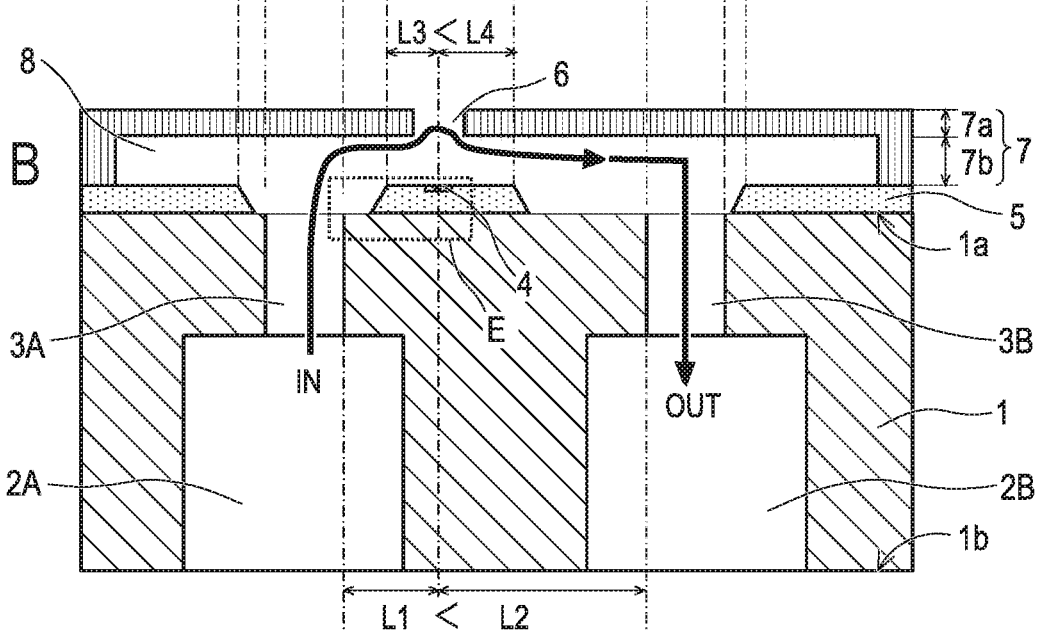
FIG. 1B is a cross-sectional view of the liquid ejection head of Embodiment 1.

FIG. 1A illustrates a plan view of the liquid ejection head of the present embodiment, and FIG. 1B illustrates a cross-sectional view taken along line A-A of FIG. 1A. The liquid ejection head has a substrate 1. The substrate 1 is formed of, for example, silicon. On the substrate 1, a supply path which penetrates a first surface (surface 1*a*) of the substrate 1 and a second surface (back surface 1*b*) opposing the first surface, is formed. In FIGS. 1A and 1B, the supply path is composed of two parts, a first supply path 2 and a second supply path 3. The supply path penetrates from a back surface side to a surface side of the substrate 1, and supplies a liquid from the back surface side to the surface side of the substrate 1. On the surface of the substrate 1, an energy-generating element 4 which generates energy for ejecting a liquid, an electrical wiring layer (not illustrated) which is electrically connected to the energy-generating element 4, and an insulating layer 5 which protects the energy-generating element 4 and the electrical wiring layer from the liquid, are provided. Examples of the energy-generating element 4 include a resistance heating element (heater element) such as TaSiN. Examples of the electrical wiring layer include Al wiring and the like. Examples of the insulating layer include inorganic insulating layers such as silicon nitride (SiN), silicon carbide (SiC), and silicon oxide (SiO, $SiO_2$). The insulating layer 5 has an opening 9, and the supply path (second supply path 3) is open inside the opening 9. The opening 9 in the insulating layer is referred to as a second opening, and an opening in the supply path is referred to as a first opening. Further, on the surface of the substrate 1, an ejection orifice member 7 which forms an ejection orifice 6 for ejecting a liquid is provided. In FIGS. 1A and 1B, the ejection orifice member 7 is formed of two layers of an ejection orifice forming portion 7*a* and a flow path forming portion 7*b*. The ejection orifice member 7 is formed of a material, for example, a resin (such as an epoxy resin), silicon, a metal, or the like. A region surrounded by the ejection orifice member 7 and the surface of the substrate 1 is a flow path 8 of a liquid. A portion of the flow path 8 which encloses the energy-generating element 4 is also referred to as a pressure chamber. The liquid energized from the energy-generating element 4 in the pressure chamber is ejected from the ejection orifice 6. Further, a plurality of ejection orifices 6 and energy-generating elements 4 are arranged in one direction in FIG. 1A (vertical direction in the drawing), and the first supply path 2 is formed so as to extend in the direction in which the energy-generating elements 4 (ejection orifices) are arranged (vertical direction in the drawing) (broken line portion in FIG. 1A). The second supply path 3 is disposed for every two energy-generating elements 4 (ejection orifices), but is not limited thereto, and a plurality of second supply paths 3 can be disposed for one or two or more.

As described above, the supply path is composed of the first supply path 2 and the second supply path 3. A plurality of individual and independent second supply paths 3, each of which is independent, is provided for one first supply path 2. Therefore, the first supply path 2 can also be referred to as a common supply path, and the second supply path 3 can also be referred to as an individual supply path. Here, the supply path is composed of two supply paths, that is, the first supply path 2 and the second supply path 3, but there may be one supply path. That is, for example, one supply path which penetrates the substrate 1 may be formed.

Further, in the case of the liquid ejection head which circulates a liquid, supply paths exist on both sides of the energy-generating element 4. The second supply path (individual supply path) 3 includes an individual inflow path 3A which makes a liquid flow in the flow path (pressure chamber) and an individual outflow path 3B which makes a liquid flow out of the flow path (pressure chamber). Further, the first supply path (common supply path) 2 includes a common inflow path 2A which communicates with a plurality of individual inflow paths 3A and a common outflow path 2B which communicates with a plurality of individual outflow paths 3B. The individual inflow path 3A and the common inflow path 2A are collectively referred to as a liquid inflow path, and the individual outflow path 3B and the common outflow path 2B are also collectively referred to as a liquid outflow path.

In the case of the present embodiment, as illustrated in FIG. 1B, the ejection orifice 6 is disposed between the liquid inflow path (individual inflow path 3A) and the liquid outflow path (individual outflow path 3B), and an end of the second opening on an ejection orifice side is formed closer to the ejection orifice than an end of the first opening. L1 to L4 represent distances from a center position of the ejection orifice 6 to the ends of the first opening and the second opening. A distance from the center position of the ejection orifice to the end of the first opening on a liquid inflow path side is L1, and a distance from the center position of the ejection orifice to the end of the first opening on a liquid outflow path side is L2. A distance from the center position of the ejection orifice to the end of the second opening on the liquid inflow path side is L3, and a distance from the center position of the ejection orifice to the end of the second opening on the liquid outflow path side is L4. In the present invention, $L1 \leq L2$ and $L3 \leq L4$ are satisfied, and when $L1=L2$ is satisfied, $L3<L4$ is satisfied, and when $L3=L4$ is satisfied, $L1<L2$ is satisfied. These distances are the shortest distances when the liquid ejection head is viewed from a position opposing the surface of the substrate. The center position of the ejection orifice is the position of the center of gravity of the ejection orifice 6. In FIGS. 1A and 1B, the ejection orifice 6 and the energy-generating element 4 corresponding to the ejection orifice are formed so that $L1<L2$ and $L3<L4$ are satisfied. Further, since the end of the second opening 9 on the ejection orifice side is formed closer to the ejection orifice side than the end of the first opening is, $L3+L4<L1+L2$ is satisfied.

Figure 7A:
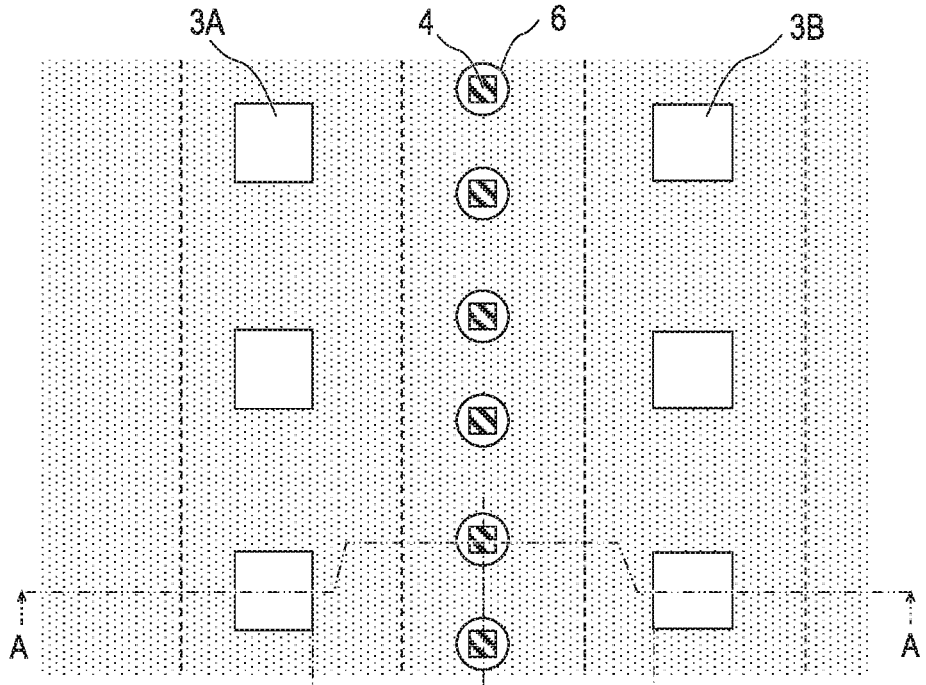
FIGS. 7A and 7B are drawings illustrating a top surface and a cross section of a liquid ejection head of a conventional example.
Figure 7B:
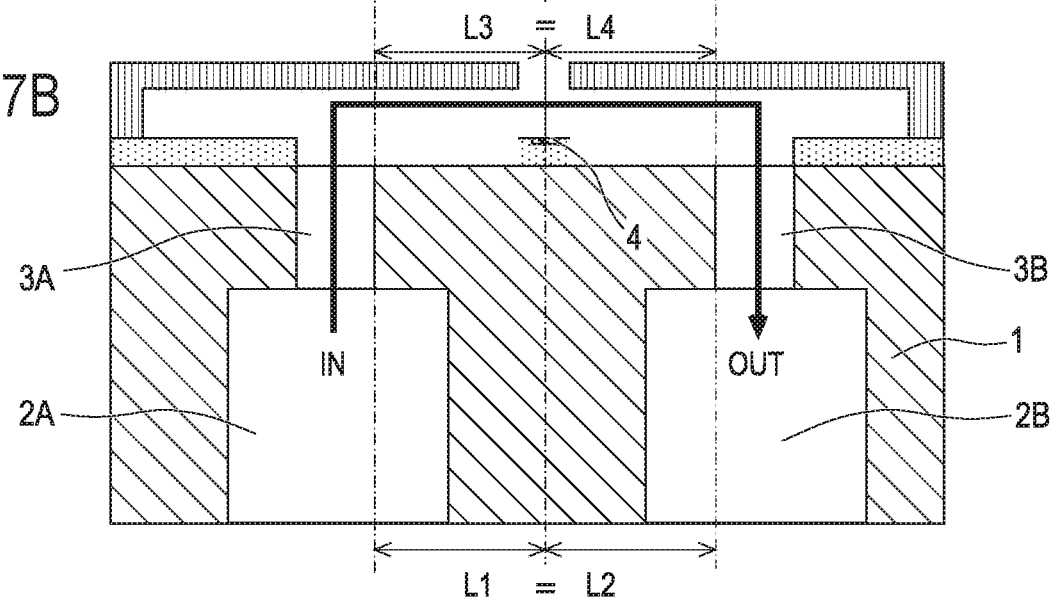

On the other hand, in the case of the conventional liquid ejection head, as illustrated in FIGS. 7A and 7B, $L1=L2$ is satisfied, the first opening and the second opening coincide with each other without removal of the insulating layer, and $L3=L4$ is satisfied. For this reason, the flow resistances in the flow paths on both sides from the center position of the ejection orifice 6 are substantially the same.

Figure 3:
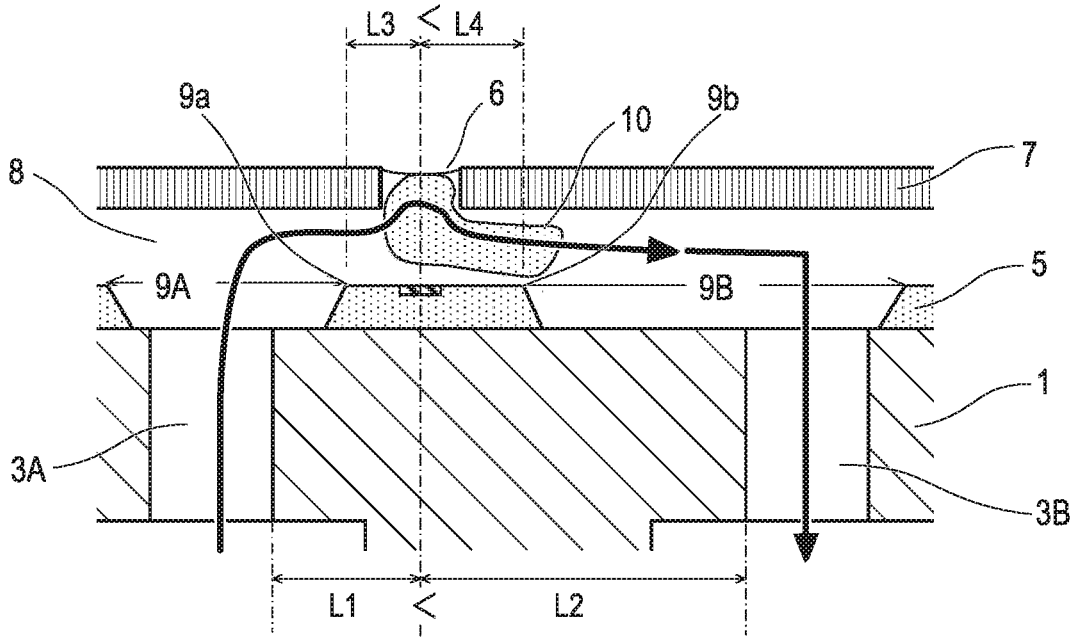
FIG. 3 is a drawing illustrating a liquid flow in the liquid ejection head of Embodiment 1.

FIG. 3 is an enlarged view in the vicinity of the ejection orifice of FIG. 1B. As illustrated in FIG. 3, when $L1<L2$ and $L3<L4$ are satisfied, there is a difference in the flow resistances on both sides of the ejection orifice, and a liquid flow in the individual inflow path is likely to affect the vicinity of the ejection orifice, whereby a portion 10 having a high liquid concentration generated in the vicinity of the ejection orifice is easily relieved.

As described above, it has been known to reduce the flow resistance of the flow path from the supply path to the energy-generating element for refilling the liquid, in the liquid ejection head of a non-circulating system. Therefore, it is considered to reduce the flow resistance by bringing both the individual inflow path and the individual outflow path closer to the energy-generating element (ejection orifice). However, a width of a partition wall between the common inflow path and the common outflow path needs to be equal to or more than a predetermined width in order to maintain mechanical strength. Therefore, when a spacing between the individual inflow path and the individual outflow path is narrowed, a crank shape is formed over the partition wall portion. Since the crank shape can be formed only by etching from both surfaces of the substrate, burrs are likely to occur in a crank portion, and it is difficult to connect with high precision.

In the present embodiment, in the liquid ejection head of a circulating system, a flow path distance to the energy-generating element is shortened only on the liquid inflow path side, and in addition to the liquid refill effect, an effect of reducing the flow resistance in the action of the liquid flow by circulation is expressed. Due to this effect, the portion 10 having a high liquid concentration generated in the vicinity of the ejection orifice can be swept away. For this reason, a spacing between the individual inflow path and the individual outflow path is maintained at a spacing which does not cover the partition wall between the common inflow path and the common outflow path, and a spacing between the ends of the openings formed in the insulating layer is narrowed, whereby the flow resistance can be further reduced.

Figure 2:
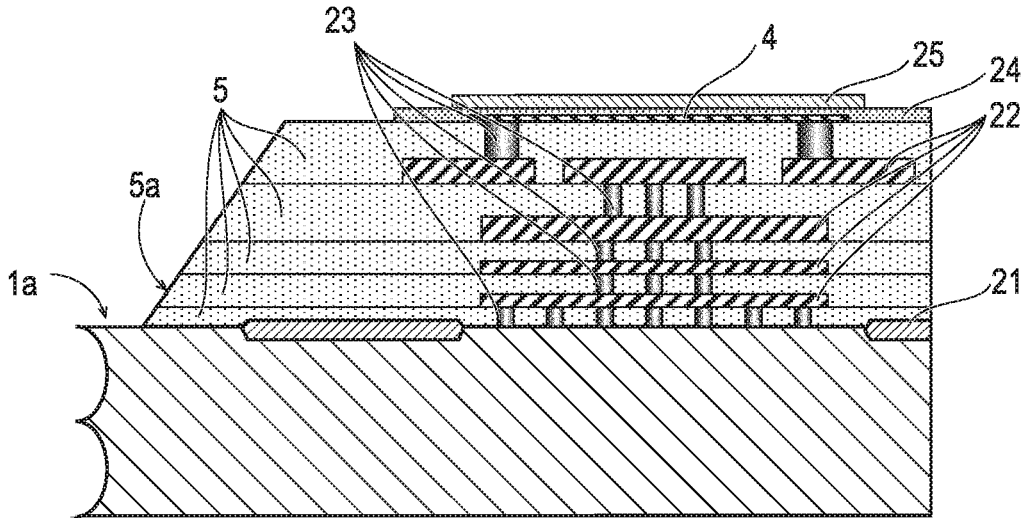
FIG. 2 is an enlarged cross-sectional view of the liquid ejection head of Embodiment 1.

In the liquid ejection head, a semiconductor element such as a switching element can be formed on a silicon substrate which is a semiconductor substrate, and further, the energy-generating element can be driven through multilayer wiring. FIG. 2 illustrates an enlarged view of a portion E surrounded by a dotted line in FIG. 1B, that is, the vicinity of the opening of the second supply path 3 on a substrate surface side. In FIG. 2, a side wall of the second supply path 3 is illustrated in a wave-like shape. This is a shape which tends to occur when the second supply path 3 is formed by a Bosch process. An oxide film 21 is formed on the surface side of the substrate 1, and an insulating layer 5 is provided thereon. The insulating layer 5 is layers formed by laminating a plurality of insulating layers, and can be formed by, for example, a plasma CVD method. Electrical wiring layers 22 are provided between the insulating layers 5. The electrical wiring layers 22 are also formed by laminating a plurality of electrical wiring layers, and these electrical wiring layers are connected to each other by plugs 23. Examples of the plug 23 include a tungsten plug. The insulating layer 5 is provided in portions where the plug 23 does not exist. This allows the plurality of electrical wiring layers 22 to be partially electrically insulated, respectively, by the insulating layers 5 at portions where the plug 23 does not exist. The electrical wiring layer 22 is electrically connected to the energy-generating element 4 and supplies electricity to the energy-generating element 4. The energy-generating element 4 is further prevented from being in contact with an ejected liquid by a passivation layer 24, and an anti-cavitation layer 25 is provided on the passivation layer 24.

It is preferred that the electrical wiring layers are layers formed by laminating a plurality of electrical wirings. By doing so, the height of the insulating layer can be increased and refill efficiency when the end of the insulating layer is retracted from an opening of a liquid supply path can be more improved. Specifically, a thickness of the insulating layer 5 is preferably 4 μm or more, and more preferably 6 μm or more. The thickness of the insulating layer 5 is the total thickness when the insulating layer is formed of a plurality of layers. Further, when there is an electrical wiring layer therebetween, the thickness includes the electrical wiring layer. By setting the thickness of the insulating layer in this manner, the height of the opening 9 of the insulating layer 5 can be increased and the flow resistance of the liquid can be decreased. The upper limit of the thickness of the insulating layer is not particularly limited, but is preferably 20 μm or less in consideration of the overall design of the liquid ejection head. The opening 9 in the insulating layer does not have to be formed by removing the entire insulating layer, but can be formed by partially removing the insulating layer. In FIGS. 1A and 1B, there is a flat portion formed by removing the insulating layer from a bottom of the opening wall surface of the insulating layer 5 to the end of the first opening (individual inflow path 3A) on the liquid inflow path side. Similarly, a flat portion formed by removing the insulating layer is provided from the bottom of the wall surface of the opening of the insulating layer 5 to the end of the first opening (individual outflow path 3B) on the liquid outflow path side.

As illustrated in FIGS. 1A and 1B, when L1<L2 is satisfied, L2/L1 is preferably 1.1 or more. By setting L2/L1 to 1.1 or more, a portion having a high liquid concentration can be efficiently relieved. Further, when L3<L4 is satisfied, it is preferred that L4/L3 is also 1.1 or more.

Next, a method for manufacturing the liquid ejection head will be described with reference to FIGS. 8A, 8B, 8C, 8D, 8E, and 8F.

Figure 8A:
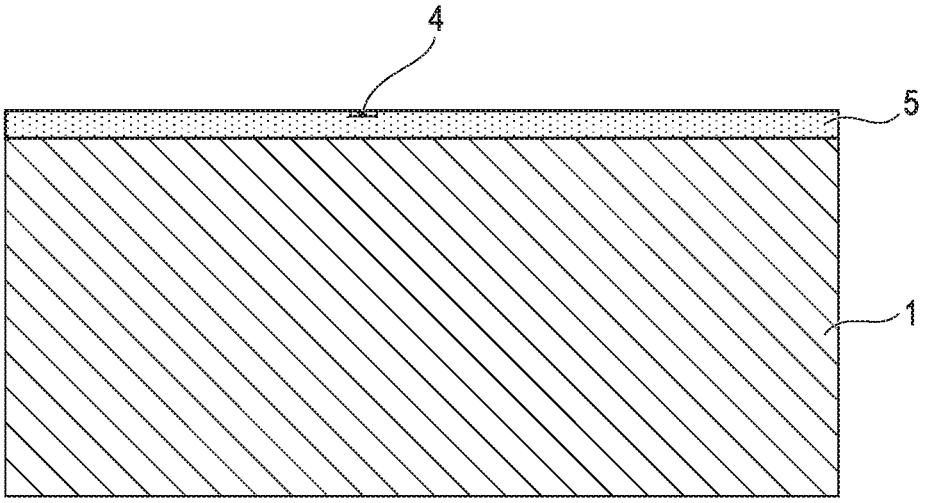
FIGS. 8A, 8B, and 8C are process cross-sectional views illustrating a manufacturing method of Example 1.

First, as illustrated in FIG. 8A, a substrate 1 having the energy-generating element 4, the insulating layer 5, and the electrical wiring layer (not illustrated) on the surface side is prepared. The insulating layer 5 is composed of multiple insulating layers, and the electrical wiring layer is provided between the insulating layers.

Figure 8B:
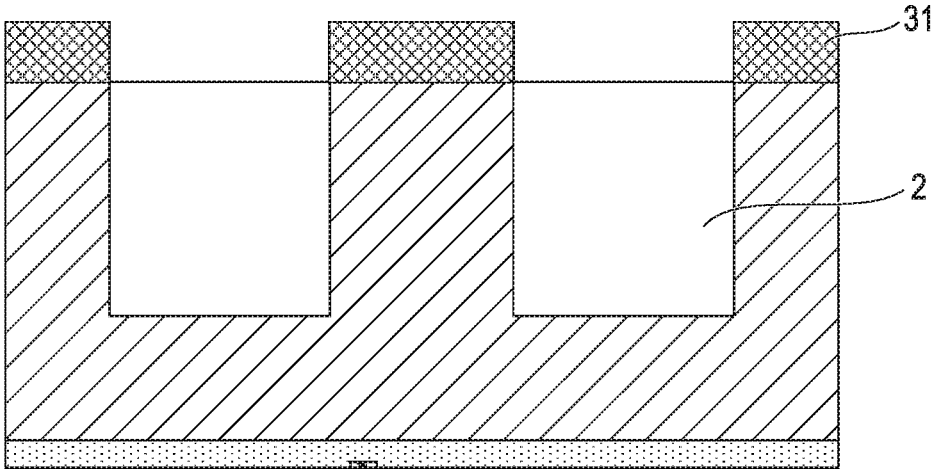

Next, as illustrated in FIG. 8B, an etching mask 31 is provided on the back surface side of the substrate 1, and the first supply path 2 is formed by reactive ion etching. The etching mask 31 can be formed of, for example, silicon oxide, silicon nitride, silicon carbide, silicon carbonitride, photosensitive resin, or the like.

Figure 8C:
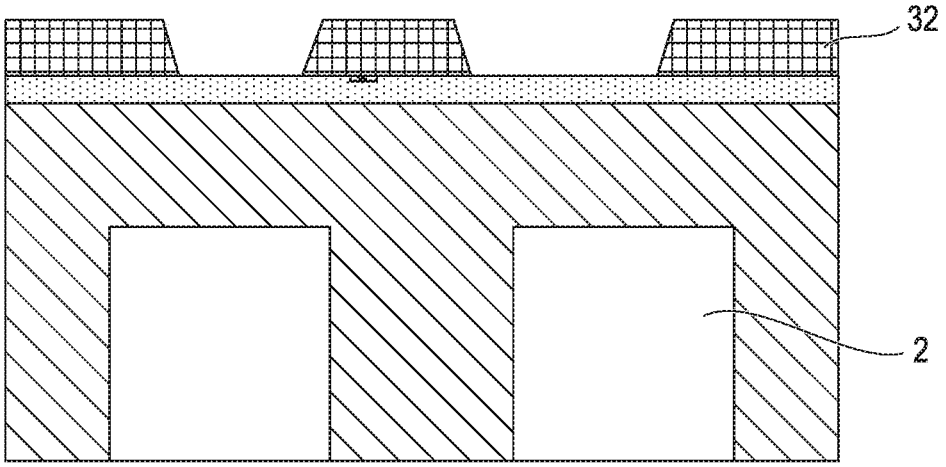

Next, as illustrated in FIG. 8C, an etching mask 32 is provided on the surface side of the substrate 1. Examples of the material for forming the etching mask 32 include the same materials as those of the etching mask 31. The cross-sectional shape of an opening portion of an etching mask 32 is preferably a tapered shape. The tapered shape can be formed by optimizing exposure conditions, PEB/development conditions, and pre-bake conditions in the patterning step.

Figure 8D:
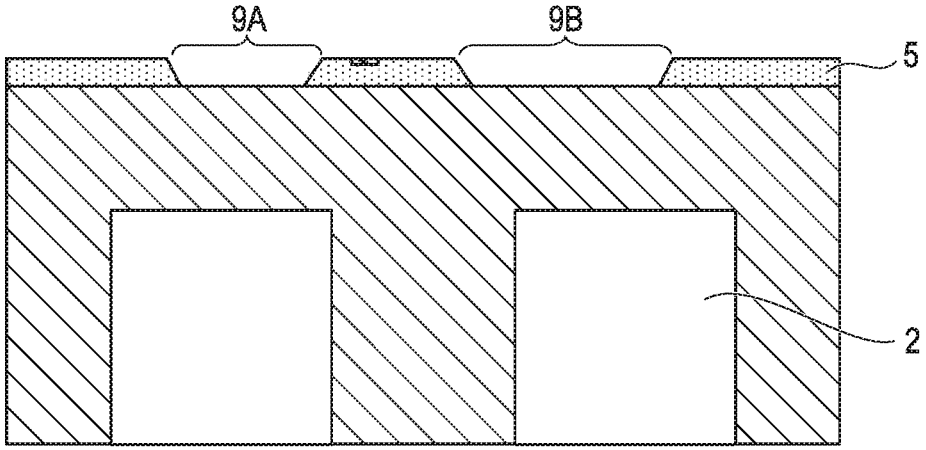
FIGS. 8D, 8E, and 8F are process cross-sectional views illustrating the manufacturing method of Example 1.

Next, as illustrated in FIG. 8D, the insulating layer 5 is etched by reactive ion etching to form an opening 9 in the insulating layer 5. In particular, when the insulating layer 5 is composed of multiple layers, it is preferable to use reactive ion etching. In this case, for example, a positive resist is first applied on the insulating layer 5, and is patterned by exposure, heating, and development to form a mask. It is preferred that this heating is performed at 90° C. or higher and 120° C. or lower. Under this condition, a taper of the opening of the mask can be 90° or more. When the reactive ion etching is performed using such a mask, the angle of a wall surface 5*a* of the insulating layer 5 can be less than 90°, and the wall surface 5*a* can be formed as an inclined surface which is inclined with respect to the surface 1*a* of the substrate 1. By using the inclined surface, the liquid flow toward the energy-generating element 4 can be improved. The angle formed by the inclined surface which is the wall surface 5*a* of the insulating layer 5 and the surface 1*a* of the substrate 1 (the angle formed by the wall surface 5*a* on the side where the insulating layer is present) is preferably 45° or more and less than 90°. By setting the angle to less than 90°, the wall surface 5*a* becomes the inclined surface which is inclined with respect to the surface 1*a* of the substrate 1. On the other hand, if the angle is less than 45°, the wall surface 5*a* is too wide in the lateral direction, which may affect the wiring and the like. Further, it is preferred that the taper angle is increased to 45° or more, and the wall surface 5*a* is positioned closer to the energy-generating element 4 side by the increased angle, from the viewpoint of refill efficiency. Further, since by having the tapered shape, the flow resistance of the liquid at the time of circulation in the present invention is also lowered, the circulation efficiency is increased and the effect of relieving the portion having a high liquid concentration is improved. FIG. 8D illustrates the state after the etching mask 32 is removed.

Figure 8E:
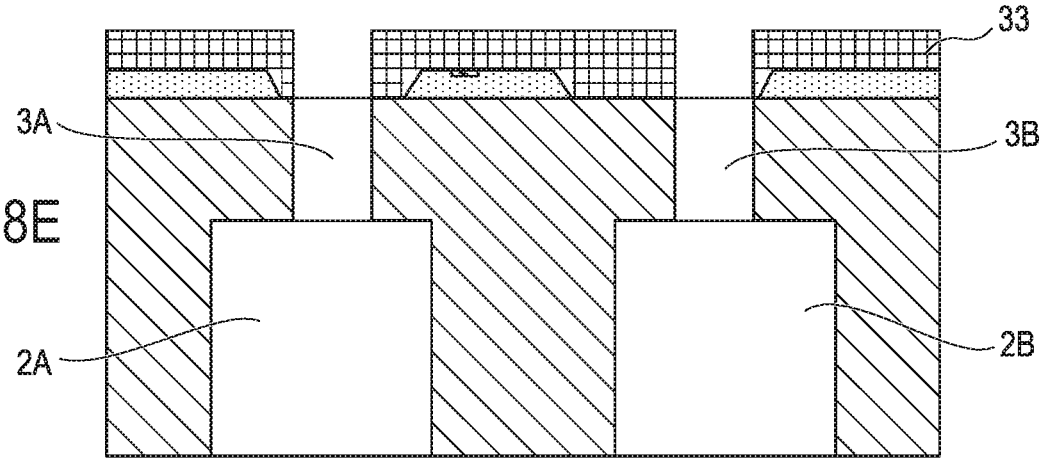

Next, as illustrated in FIG. 8E, the etching mask 33 is formed on the surface side of the substrate 1. Examples of the material for forming the etching mask 33 may be the same material as those of the etching mask 31. Then, the substrate 1 is etched to form the second supply path 3. The position where the second supply path 3 is formed is inside the opening 9. At least on the side where the energy-generating element 4 is provided, the second supply path 3 is formed inside the opening 9 at a position spaced from the opening 9. Therefore, etching is performed in a state where the etching mask 33 is disposed inside of the opening 9 to form the second supply path 3. By doing so, the end of the opening side of the supply path of the insulating layer can be in the position closer to the side where the energy-generating element was provided from the edge of the opening of the supply path.

Figure 8F:
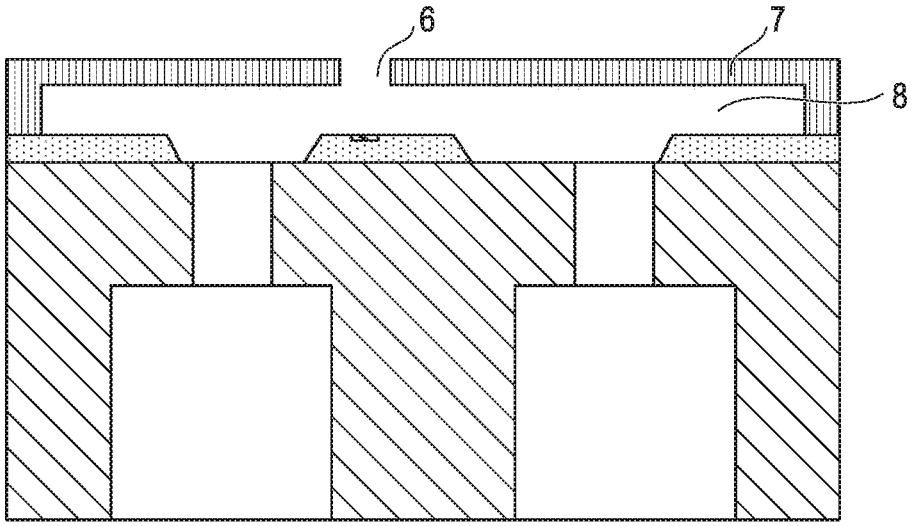

Thereafter, the etching mask 33 is removed, and the ejection orifice member 7 for forming the flow path 8 and the ejection orifice 6 is provided as illustrated in FIG. 8F. For example, the ejection orifice member 7 can be formed using a plurality of dry films. Examples of the dry film include a polyethylene terephthalate (hereinafter referred to as PET) film, a polyimide film, a polyamide film, and the like. After the dry film is attached to the substrate 1, a support member of the dry film is peeled off. Thus, it is preferred to perform a mold release treatment between the dry film and the support member.

As described above, the liquid ejection head of the present invention can be manufactured.

Embodiment 2

Figure 4A:
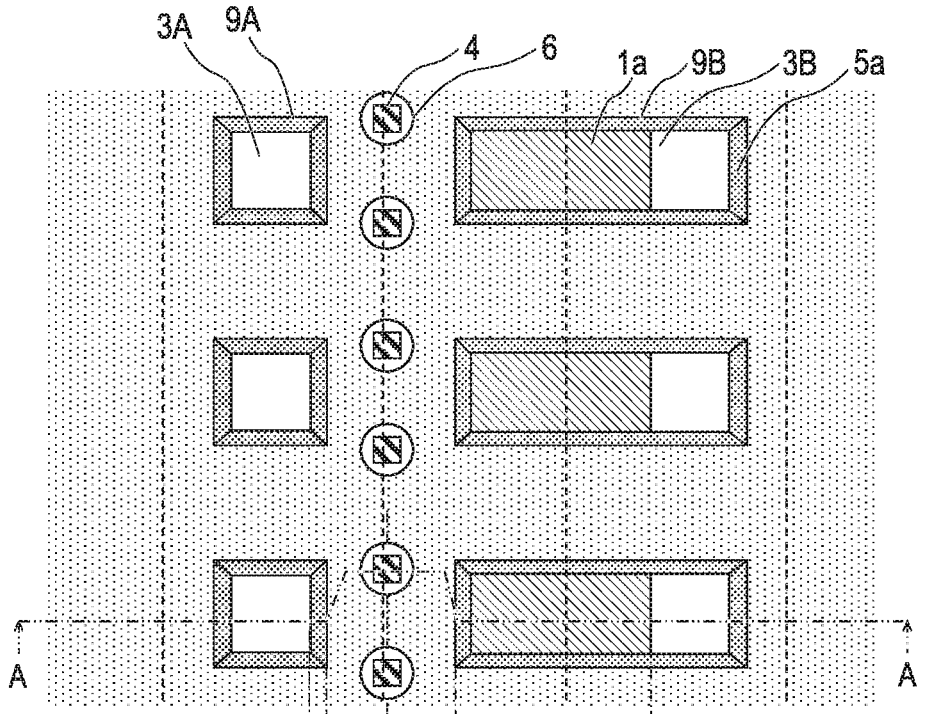
FIGS. 4A and 4B are drawings illustrating an upper surface and a cross section of the liquid ejection head of Embodiment 2.
Figure 4B:
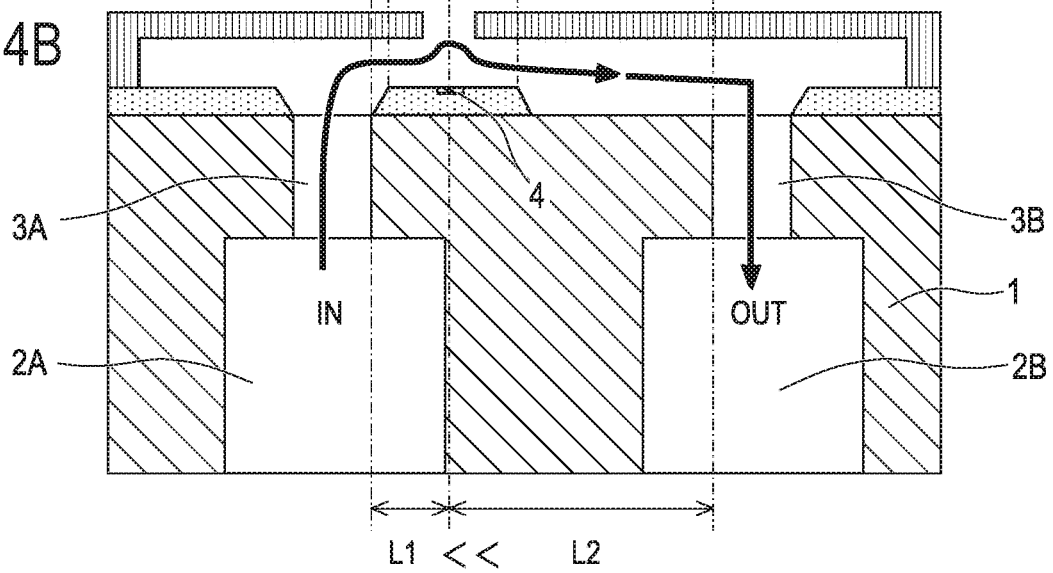

FIGS. 4A and 4B illustrate a liquid ejection head of Embodiment 2. Differences from Embodiment 1 will be mainly described.

In the present embodiment, as compared to Embodiment 1, the distance L1 is further shortened and L3 and L4 are substantially the same. Further, the bottom of the opening 9A of the insulating layer is formed to substantially coincide with the opening shape of the individual inflow path 3A. This can be achieved by performing formation of the opening 9A and the individual inflow path 3A using the same mask, as shown in Example 2 described later.

In the present embodiment, the position of the second supply path with respect to the first supply path is the same, and the positions of the energy-generating element and the ejection orifice are different from those of Embodiment 1. By forming the individual inflow path 3A to be close to the energy-generating element 4, a refill characteristic is further improved. Further, since it is not necessary to change the position of the second supply path with respect to the first supply path, it is not necessary to form the connecting portion of the two in a crank and problems such as burrs do not occur.

Embodiment 3

Figure 5A:
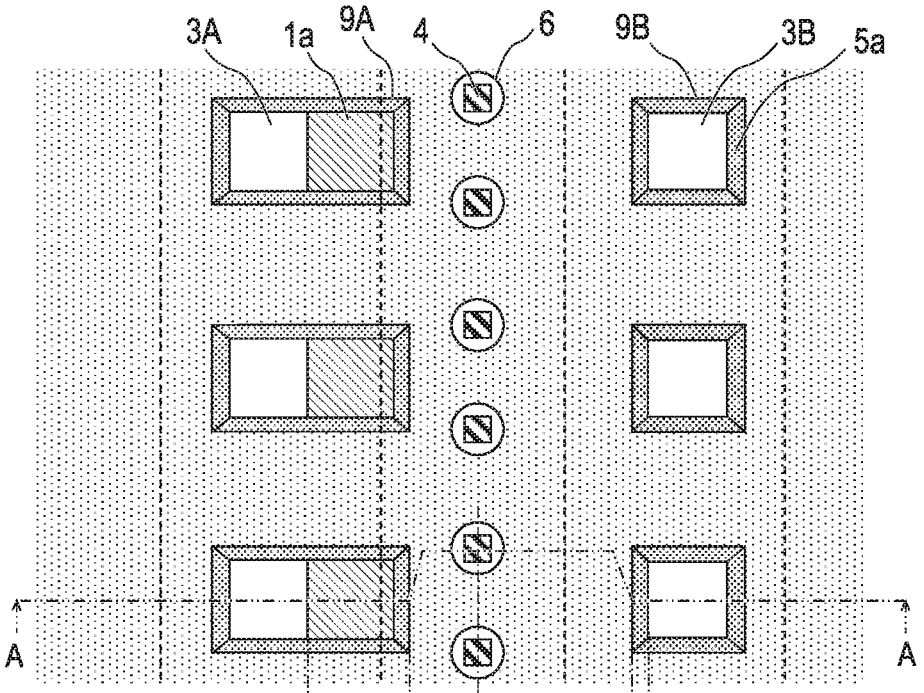
FIGS. 5A and 5B are drawings illustrating an upper surface and a cross section of the liquid ejection head of Embodiment 3.
Figure 5B:
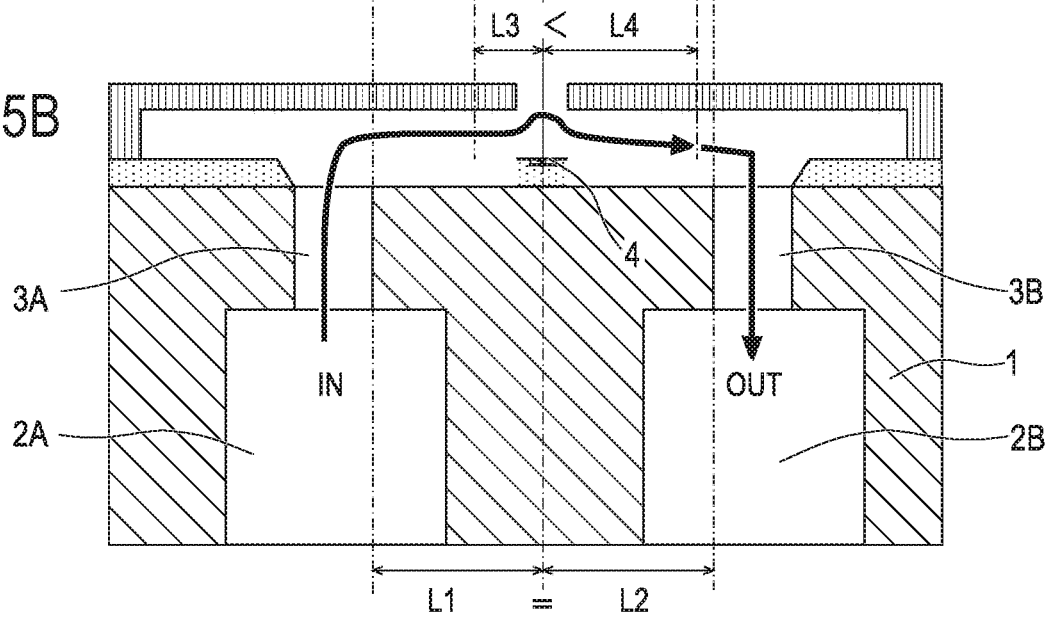

FIGS. 5A and 5B illustrate the liquid ejection head of Embodiment 3. Differences from Embodiments 1 and 2 will be mainly described.

In the present embodiment, the individual inflow path 3A, the individual outflow path 3B, the ejection orifice 6, and the energy-generating element 4 are formed so that L1=L2 is satisfied.

On the other hand, a removing position of the insulating layer is formed so that the individual inflow path side is wider, that is, L3<L4 is satisfied. By changing the shape of the opening 9 formed in the insulating layer 5 in this manner, the portion having a high liquid concentration can be sufficiently relieved by circulating the liquid.

Embodiment 4

Figure 6A:
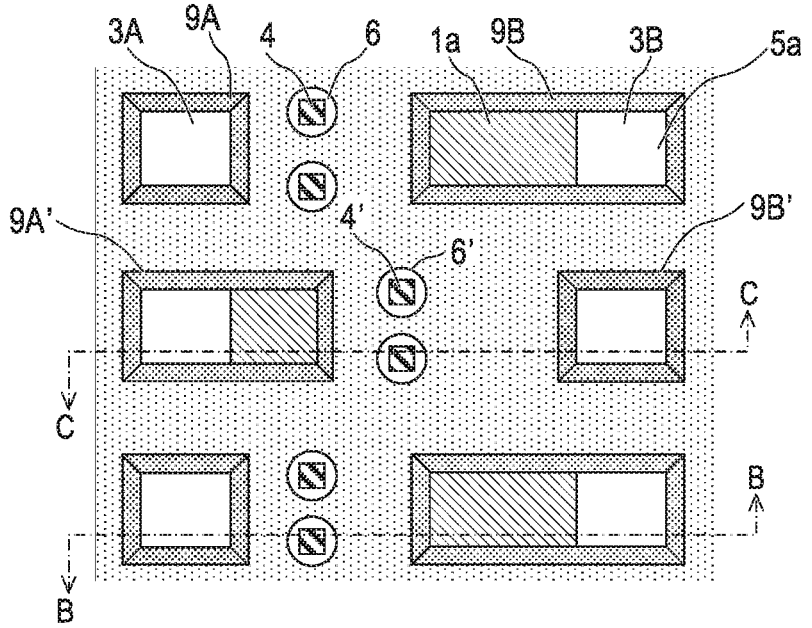
FIGS. 6A, 6B, and 6C are drawings illustrating a top surface and a cross section of the liquid ejection head of Embodiment 4.
Figure 6B:
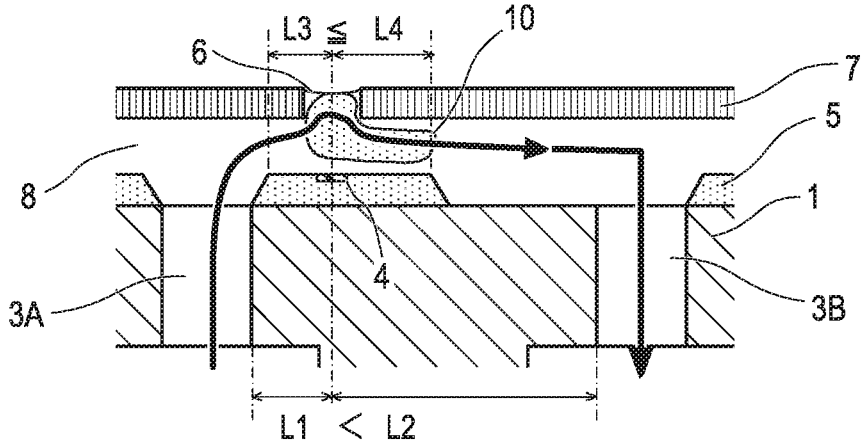
Figure 6C:
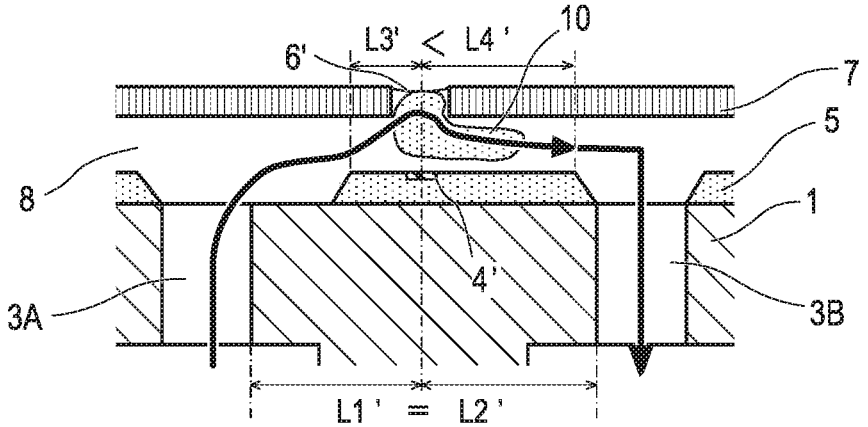

FIGS. 6A, 6B, and 6C illustrate the liquid ejection head of Embodiment 4.

As illustrated in the plan view of FIG. 6A, the energy-generating elements 4 and the ejection orifices 6 were formed in a staggered arrangement. That is, the energy-generating elements 4 and the ejection orifices 6 are arranged in a staggered arrangement of a first column closer to the individual inflow path 3A side and a second column positioned in the middle of the individual inflow path 3A and the individual outflow path 3B, for the arrangement direction (vertical direction in the drawing). Therefore, a B-B cross section (FIG. 6B) is formed so that L1<L2 and L3≤L4 are satisfied, as in Embodiments 1 and 2. A group of the liquid inflow path and the liquid outflow path in FIG. 6B is referred to as a liquid inflow path group and a liquid outflow path group corresponding to the first column. A C-C cross section illustrated in FIG. 6C is formed so that L1'=L2' and L3'<L4' are satisfied, as in Embodiment 3. A group of the liquid inflow path and the liquid outflow path in FIG. 6C is referred to as a liquid inflow path group and a liquid outflow path group corresponding to the second column. Here, formation positions of the energy-generating elements 4 and the ejection orifices 6 in the first column and the second column are optimized within a range satisfying the relationship of L1<L1'≤L2'<L2. By disposing the energy-generating element 4 and the ejection orifices 6 in a staggered manner as described above, a degree of design freedom of electrical wiring is improved and a degree of ejection design freedom is also increased. Further, in both the first column and the second column, the portion 10 having a high liquid concentration can be relieved by optimizing the positions of the first opening, the second opening, and the ejection orifice as illustrated in FIGS. 6B and 6C.

EXAMPLES

Hereinafter, the present invention will be described in more detail using examples.

Example 1

A method of manufacturing the liquid ejection head will be described. First, as illustrated in FIG. 8A, a substrate 1 having an energy-generating element 4 made of TaSiN, an insulating layer 5 made of silicon oxide, and an electrical wiring layer (not illustrated) made of Al on a surface side was prepared. The substrate 1 is a silicon single crystal substrate. The insulating layer 5 was multilayer and had a thickness of 10 μm. Four electrical wiring layers are provided inside the insulating layer 5, and each electrical wiring layer is connected by a tungsten plug.

Next, as illustrated in FIG. 8B, an etching mask 31 was provided on a back surface opposite to the surface, and a first supply path 2 was formed by reactive ion etching. At this time, an opening portion of the etching mask formed on both sides so that the energy-generating element on the surface side was interposed was formed so that the end of the opening 9A was closer with the energy-generating element interposed therebetween. In the present embodiment, the etching mask 31 was formed of a novolac photoresist. A depth of the first supply path 2 was 500 μm, $SF_6$ gas was used for an etching step, $C_4F_8$ gas was used for a coating step, a gas pressure was 10 Pa, and a gas flow rate was 500 sccm. Further, an etching time was 20 seconds, a coating time was 5 seconds, and a bias power of 150 W was applied to a platen for 10 seconds of the etching time. This is an etching technique called a Bosch process of the reactive ion etching.

Next, the etching mask 31 was removed, and as illustrated in FIG. 8C, an etching mask 32 was provided on the surface side of the substrate 1. For formation of the etching mask 32, first, a novolac positive resist was applied with a thickness of 20 μm and prebake was performed at 150° C. Next, the etching mask was formed by exposure and development.

Next, using the etching mask 32 as a mask, the insulating layer 5 was etched by reactive ion etching to form openings 9A and 9B in insulating layer 5, as illustrated in FIG. 8D. The reactive ion etching was performed using a mixed gas of $C_4F_8$ gas, $CF_4$ gas, and Ar gas, with a flow rate of $C_4F_8$ gas of 10 sccm, and a bias power of 100 W was applied to the platen. At the time of etching, the substrate 1 made of silicon becomes an etching stop layer. That is, as etching of the insulating layer proceeds, the etching region (etching gas) reaches the substrate 1. Since an etching selection ratio between the insulating layer 5 and the substrate 1 is 100 or more, the etching is stopped after the etching reaches the substrate 1. In this way, the substrate 1 is used as an etching stop layer. In addition, when the overetching is performed 20% after etching the insulating layer, the calculation results in the substrate 1 being scraped by 0.02 μm. Therefore, the height of the insulating layer 5 is almost the same as the height of the opening 9.

Next, as illustrated in FIG. 8E, an etching mask 33 was formed. The etching mask 33 was formed with a film thickness of 20 μm, using a novolac positive resist, and was patterned by photolithography. The opening position was formed to be inside the openings 9A and 9B. Subsequently, in the same manner as in the formation of the first supply path 2, the substrate 1 was etched by reactive ion etching to form the second supply path 3.

Thereafter, the etching mask 33 was removed, and as illustrated in FIG. 8F, the ejection orifice member 7 forming the flow path 8 and the ejection orifice 6 was formed by attaching a dry film containing an epoxy resin to the substrate 1.

As described above, the liquid ejection head of the present invention illustrated in FIGS. 1A and 1B was manufactured.

In the liquid ejection head of Example 1, since the ejection orifice 6 is close to the individual inflow path 3A side (L1<L2), a portion 10 having a high liquid concentration generated in the vicinity of the ejection orifice is close to the individual inflow path 3A, as illustrated in FIGS. 1A and 1B. Further, since a distance L3 to the end of the ejection orifice side of the opening 9A is also shorter than a distance L4 to the end of the ejection orifice side of the opening 9B (L3<L4), the liquid flow from the individual inflow path 3A is more likely to be effective in the vicinity of the ejection orifice, and the portion 10 having a high concentration was relieved. Further, since the opening position of the insulating layer in the individual outflow path side is removed at a position close to the energy-generating element, the liquid ejection head was stably refilled after liquid ejection and was highly reliable without image quality deterioration.

Example 2

The liquid ejection head illustrated in FIGS. 4A and 4B was manufactured.

Figure 9A:
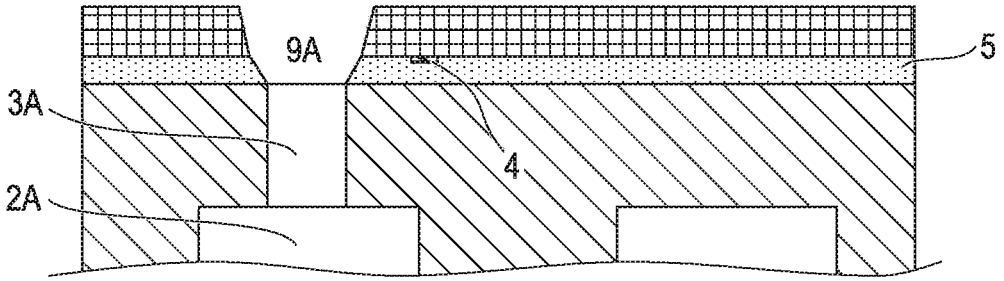
FIGS. 9A, 9B, 9C, and 9D are process cross-sectional views illustrating a manufacturing method of Example 2.

A common supply path 2 was formed in the same manner as in Example 1, and an etching mask 32 was formed on the surface side of the substrate 1. At this time, the etching mask 32 was formed so that only the second supply path (individual inflow path 3A) on one side was open with the energy-generating element interposed therebetween. After the opening 9A was formed by etching the insulating layer, the substrate 1 was etched using the mask to communicate with the common inflow path 2A (FIG. 9A). By etching the insulating layer and silicon with the same mask, there is no need to worry about patterning shift such as alignment shift, as compared with the case of exposing twice, and thus, the energy-generating element 4 can be brought closer to the individual inflow path 3A side by about 2 μm. As a result, the ejection orifice 6 positioned directly above the energy-generating element 4 can also be brought closer to the individual inflow path 3A side.

Figure 9B:
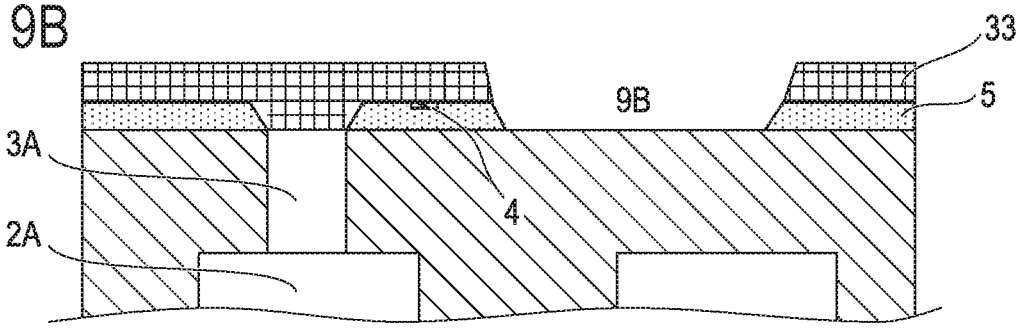
Figure 9C:
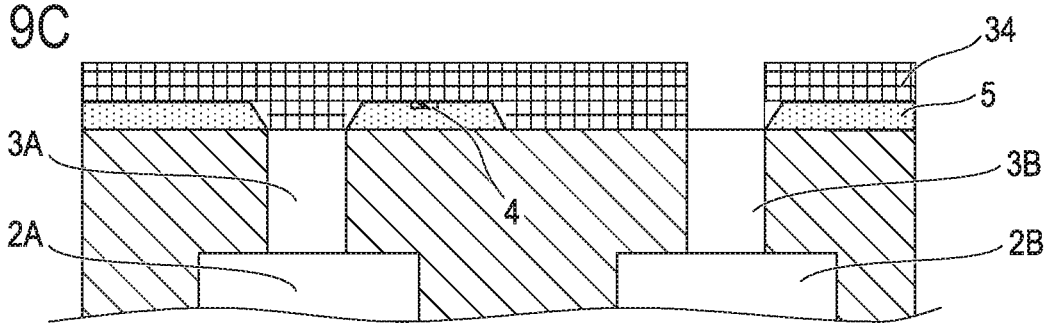

Thereafter, the etching mask 32 was removed, the etching mask 33 for opening the other second supply path was formed, and an opening 9B was formed in the insulating layer 5 by etching (FIG. 9B). Further, after removing the etching mask 33, the etching mask 34 is formed, and the individual outflow path 3B, which is the other second individual supply path, was communicated with the common outflow path 2B by etching the substrate silicon (FIG. 9C). However, the order of forming the individual supply path and the common supply path is not limited thereto.

Figure 9D:
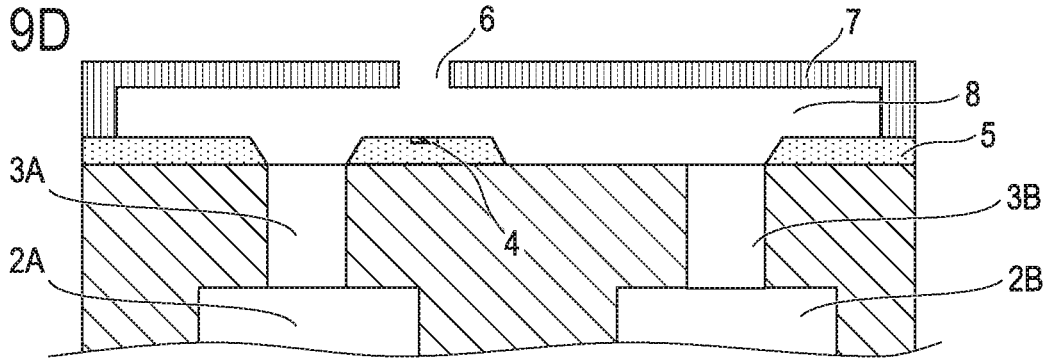

Thereafter, in the same manner as in Example 1, the ejection orifice member 7 which forms the flow path 8 and the ejection orifice 6 was formed to manufacture the liquid ejection head of Example 2 (FIG. 9D). In the liquid ejection head of Example 2, as compared with Example 1, the ejection orifice 6 is closer to the individual inflow path 3A side, the liquid flow in the vicinity of the ejection orifice is more likely to be affected, and the portion having a high liquid concentration was more relieved. Further, the liquid ejection head was stably refilled after the liquid ejection and was highly reliable without image quality deterioration.

Example 3

The liquid ejection head illustrated in FIGS. 5A and 5B was manufactured.

A common supply path 2 was formed in the same manner as in Example 1, and an etching mask 32 on the surface side of the substrate 1 was formed. Though the common supply path 2 was formed in the same manner as in Example 1, the opening position of the etching mask 32 was formed to be in an equal distance with the energy-generating element interposed therebetween.

Thereafter, as a method of forming the individual supply path, the removing position of the insulating layer was formed so that the individual inflow path side was widened. A subsequent method of forming the individual supply paths was the same as in Example 1.

As described above, the liquid ejection head of Example 3 was manufactured. In the liquid ejection head of Example 3, the portion having a high liquid concentration was relieved in the same manner as in Example 1, and the ejection head was a highly reliable liquid ejection head without image quality deterioration.

Example 4

The liquid ejection head illustrated in FIGS. 6A, 6B, and 6C was manufactured.

A common supply path 2 was formed in the same manner as in Example 1, on the substrate on which the energy-generating elements 4 were arranged in a staggered manner, and an etching mask 32 on the surface side of the substrate 1 was formed. The etching mask opening positions were formed in a staggered arrangement on the plane of the substrate surface. FIGS. 6A, 6B, and 6C illustrate an example of the staggered arrangement, and the present invention is not limited thereto.

By arrangement in a staggered manner as described above, a degree of design freedom on the electrical wiring is improved, and a degree of ejection design freedom is also increased.

As described above, the liquid ejection head of Example 4 was manufactured. In the liquid ejection head of Example 4, the portion having a high liquid concentration was relieved in the same manner as in Example 1, and the ejection head was a highly reliable liquid ejection head without image quality deterioration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-240864, filed Dec. 25, 2018, which is hereby incorporated by reference herein in its entirety.

What is claimed is:

1. A liquid ejection head, comprising:

an ejection orifice for ejecting a liquid;

a substrate on which an energy-generating element which generates energy for ejecting the liquid from the ejection orifice and an insulating layer which protects the energy-generating element from the liquid are formed on a first surface;

a liquid inflow path which penetrates from the first surface of the substrate to a second surface opposing the first surface to allow a liquid flow in a flow path disposed between the ejection orifice and the energy-generating element; and a liquid outflow path which penetrates from the first surface of the substrate to the second surface to allow the liquid flow out of the flow path, wherein the liquid inflow path and the liquid outflow path each respectively have a first opening penetrating the substrate and a second opening penetrating the insulating layer, the ejection orifice is disposed between the liquid inflow path and the liquid outflow path, and an ejection orifice side end of the second opening is formed closer to the ejection orifice than an ejection orifice side end of the first opening for each of the liquid inflow path and the liquid outflow path, when a distance from a center position of the ejection orifice to the ejection orifice side end of the first opening of the liquid inflow path is L1, a distance from the center position of the ejection orifice to the ejection orifice side end of the first opening of the liquid outflow path is L2, a distance from the center position of the ejection orifice to the ejection orifice side end of the second opening of the liquid inflow path is L3, and a distance from the center position of the ejection orifice to the ejection orifice side end of the second opening of the liquid outflow path is L4, L1, L2, L3, and L4 satisfy:

L1=L2 and L3<L4, or

L1<L2 and L3<L4, or

L1<L2 and L3=L4.

2. The liquid ejection head according to claim 1, wherein an opening wall surface of the insulating layer has an inclined surface inclined with respect to the first surface of the substrate.

3. The liquid ejection head according to claim 2, wherein an angle formed by the opening wall surface of the insulating layer and a surface of the substrate is 45° or more and less than 90°.

4. The liquid ejection head according to claim 2, wherein a flat portion formed by removing the insulating layer is provided from a bottom portion of a wall surface of the second opening on the ejection orifice side to the ejection orifice side end of the first opening in at least one of the liquid inflow path and the liquid outflow path.

5. The liquid ejection head according to claim 3, wherein a flat portion formed by removing the insulating layer is provided from a bottom portion of a wall surface of the second opening on the ejection orifice side to the ejection orifice side end of the first opening in at least one of the liquid inflow path and the liquid outflow path.

6. The liquid ejection head according to claim 1, wherein when the relation between L1 and L2 satisfies L1<L2, L2/L1 is 1.1 or more.

7. The liquid ejection head according to claim 1, wherein the insulating layer is a layer including an electrical wiring layer.

8. The liquid ejection head according to claim 1, wherein a thickness of the insulating layer is 4 μm or more.

9. The liquid ejection head according to claim 1, wherein the liquid inflow path and the liquid outflow path include a first supply path which is open to the second surface of the substrate and a plurality of second supply paths which are open to the first surface of the substrate, and the plurality of the second supply paths communicates with the first supply path.

10. The liquid ejection head according to claim 9, wherein the liquid ejection head has a plurality of ejection orifices arranged in an arrangement direction, the first supply path is formed to extend in the arrangement direction of the ejection orifices, and the plurality of the second supply paths is disposed in the arrangement direction of the ejection orifices with respect to one or two or more ejection orifices.

11. The liquid ejection head according to claim 1, wherein the liquid ejection head has a plurality of ejection orifices and the ejection orifices are disposed in a staggered arrangement of a first column and a second column with respect to an arrangement direction of the ejection orifices, and the liquid ejection head includes:

a liquid inflow path group and a liquid outflow path group corresponding to the first column; and a liquid inflow path group and a liquid outflow path group corresponding to the second column.

12. The liquid ejection head according to claim 1, wherein the liquid in the flow path is circulated between the flow path and an outside of the liquid ejection head.

* * * * *